US006048613A

United States Patent [19]

Yamakawa et al.

[11] Patent Number: 6,048,613

[45] Date of Patent: Apr. 11, 2000

[54] ELASTIC POLYURETHANE YARN AND METHOD OF MANUFACTURING THE SAME

[75] Inventors: Yukio Yamakawa; Yasushi Nakai; Kiyoshi Yoshimoto; Shigeru Tokutomi; Teruyoshi Kawata, all of Hofu, Japan

[73] Assignee: Kanebo, Limited, Tokyo, Japan

[21] Appl. No.: 09/194,745

[22] PCT Filed: Jun. 2, 1997

[86] PCT No.: PCT/JP97/01874

§ 371 Date: Mar. 19, 1999

§ 102(e) Date: Mar. 19, 1999

[87] PCT Pub. No.: WO97/46748

PCT Pub. Date: Dec. 11, 1997

[30] Foreign Application Priority Data

Jun. 3, 1996 [JP] Japan ..... 8-160488

[51] Int. Cl.[7] ..... D01F 8/14; D01F 6/94

[52] U.S. Cl. ..... 428/364; 428/394; 428/400; 428/373; 525/440

[58] Field of Search ..... 428/364, 394, 428/373, 400; 525/440

[56] References Cited

U.S. PATENT DOCUMENTS

| | | | |
|---|---|---|---|
| 4,034,016 | 7/1977 | Baron et al. | 260/858 |
| 5,319,039 | 6/1994 | Moses et al. | 525/440 |
| 5,502,120 | 3/1996 | Bhatt et al. | 525/440 |

FOREIGN PATENT DOCUMENTS

| | | |
|---|---|---|
| 850419 | 8/1977 | Belgium . |
| 0618263 | 3/1994 | European Pat. Off. . |
| 2646647 | 4/1977 | Germany . |
| 50-053448 | 5/1975 | Japan . |
| 52-050350 | 4/1977 | Japan . |
| 52-102365 | 8/1977 | Japan . |
| 53-009851 | 1/1978 | Japan . |
| 3-263457 | 11/1991 | Japan . |
| 4-275364 | 9/1992 | Japan . |
| 4-275365 | 9/1992 | Japan . |
| 6-313093 | 8/1994 | Japan . |
| 70-03135 | 1/1995 | Japan . |
| 70-03136 | 1/1995 | Japan . |
| 70-11111 | 1/1995 | Japan . |

*Primary Examiner*—Newton Edwards
*Attorney, Agent, or Firm*—Morgan & Finnegan, LLP

[57] ABSTRACT

The present invention relates to melt-spun polyurethane elastic fiber having a degree of luster of 70 or less, the degree of luster being defined as (I/Io)×100 where the amount of light reflecting off the surface of the fiber is I and the amount of light reflecting off a standard white plate is Io. On the surface of preferable polyurethane elastic fiber, 10 or more mountain-like protrusions of 0.2 to 5.05 to 110 parts by weight of 5 to 110 parts by weight of $\mu$m in height are present every 10 $\mu$m fiber in the axial direction.

Also, the present invention relates to a process for producing polyurethane elastic fiber, comprising melt-spinning butylene terephthalate-based crystalline polyester (A) and thermoplastic polyurethane (B) wherein before spinning, the compound (A) is melt-mixed with thermoplastic polyurethane (B-1) having isocyanate groups in an amount of 150 to 500 $\mu$mol/g.

Further, the present invention relates to covered fiber comprising the polyurethane elastic fiber as a core.

Even if stockings, tights, sox etc. are produced using the covered fiber of the present invention, the luster phenomenon as the drawback of particularly melted spun urethane does not occur, so it is possible to obtain products with excellent appearance.

6 Claims, 2 Drawing Sheets

Magnification: 1,000 10 μm

Magnification: 3,500 5 μm

Magnification: 1,000 10 μm

Magnification: 3,500 5 μm

ELASTIC POLYURETHANE YARN AND METHOD OF MANUFACTURING THE SAME

FIELD OF THE INVENTION

The present invention relates to polyurethane elastic fiber and a process for producing the same.

BACKGROUND OF THE INVENTION

The polyurethane elastic fiber has excellent stretching properties and is widely used in the fields of hosiery, underwear, sportswear etc.

Known processes for producing the polyurethane elastic fiber include a wet spinning method where a polyurethane solution is extruded and coagulated by passage through a coagulation bath, a dry spinning method where solvent is vaporized with hot air, or a melt spinning method where thermoplastic polyurethane is melted and extruded followed by solidification by cooling with air. Among these spinning processes, the melt spinning process is particularly advantageous in that organic solvent with strong possibility of polluting the human body and the environment is not used, so this process recently has attracted considerable attention as a spinning process which is not detrimental to the environment.

The melt spinning process is a process in which melted polyurethane is extruded through a spinning nozzle into air, solidified by cooling and wound as described above, so unlike the dry or wet spinning process, no volatiles are contained from the melting step to the cooling and solidification step. Accordingly, this melt spinning process is characterized in that the surface of the resulting fiber is frat and free of the uneven surface generated upon removal of volatiles from the inside of the fiber. Because of these characteristics, the polyurethane elastic fiber produced by the melt-spinning process is superior in wear resistance and further possesses the property of glistening.

However, relatively thin knitted goods such as stockings, tights, sox etc. have the disadvantage of too high glistening due to the above surface property of polyurethane elastic fiber. For example, black knitted goods generate glossy black luster. In stockings, tights, sox etc. made of covered fiber having nylon fiber etc. wound around the polyurethane elastic fiber, this luster phenomenon occurs very significantly due to relatively low degrees of coverage on the polyurethane elastic fiber.

To reduce the luster phenomenon, there is a method of increasing the number of twisting in the covering step in order to increase degrees of coverage. However, there is the disadvantage that the fiber is felt hard in proportion with an increase in the number of twisting for coverage. Further, there is also a method of dyeing the polyurethane elastic fiber darkly (e.g. black). However, the reduction in luster attained in this method is slight so significant improvements cannot be achieved.

There is also a known method of decreasing the luster phenomenon by roughening the surface of fiber. For example, there is a general method of roughening the surface of polyethylene terephthalate fiber by mixing inorganic fine particles with a polymer to form fiber and then dissolving and removing the surface of the fiber with a chemical such as alkali etc. to cause the inorganic fine particles to be removed therefrom so that the surface of the fiber is roughened.

Although this method is effective for polyethylene terephthalate fiber, it cannot be applied to polyurethane elastic fiber because there is no suitable chemical which can dissolve and remove the fiber surface.

Further, there is a method in which a large amount (e.g. about 30 to 40% by weight) of inorganic fine particles are previously mixed with a polyurethane polymer and melt-spun, and the surface of the resulting fiber is roughened in the step of solidifying the fiber by cooling. In this method, however, because a large amount of inorganic particles are contained in the polymer, the melt fluidity of the polymer is lowered, and in melt spinning, the polymer clogs a spinning nozzle, or fiber cutting frequently occurs to make spinning substantially infeasible. Even if spinning is feasible, the physical properties of fiber, such as strength, elongation etc. are significantly deteriorated.

In production of polyurethane elastic fiber by the dry spinning process, concave portions are generated after solvent is removed by heating for removal of volatiles. Further, there may occur cracking etc. in fiber by thermal deterioration, but there are a small number of concave portions, cracking is not significant, thus making the state of luster high. However, in polyurethane elastic fiber produced by the dry spinning process, upon being formed into knitted goods and then subjected to a dyeing step, a large number of concave portions and a large number of cracks are generated on the surface of the fiber because of removal of volatiles from the inside of the elastic fiber through the surface of the fiber to the outside, so the actual product has few problems resulting from the luster phenomenon.

However, knitted goods produced without undergoing a wet-heating step, for example tights etc. produced by previously dyeing nylon fiber as covering fiber, have high degrees of luster because volatiles in the inside of the polyurethane elastic fiber are not discharged to the outside.

Japanese Patent Publication No. 45684/1993 discloses a method of producing polyurethane elastic fiber by compounding aliphatic saturated dicarboxylic acid in an amount of 0.1 to 5 weight-% with polyurethane followed by dry spinning to produce polyurethane elastic fiber having a large number of uneven portions on the surface of the fiber. That is, this method is different from the present invention in that the aliphatic saturated dicarboxylic acid is compounded and the dry spinning method is used. The effect of the invention is also different between the present invention and this prior art method in that the former is directed to reduction in luster while the latter to improvements in stretching properties and traveling smoothness.

Further, the method described in the above-described patent publication is different from the present invention in that uneven portions on the surface of the fiber in the former are wavy (mountain range-like) while those in the latter are independent mountain-like protrusions. If the fiber is stretched for use, the uneven portions on the fiber surface disappear in the case of the wavy shape. On the other hand, the independent mountain-like protrusions such as those in the present invention maintain the uneven portions on the fiber surface. From this difference, the fiber of the present invention brings about significant reduction in the luster phenomenon. This difference in the effect is brought about by adopting the above constitution of the present invention.

A mixture of crystalline polyester based on polybutylene terephthalate and polyurethane is disclosed in Japanese Laid-Open Patent Publication Nos. 53448/1975, 50350/1977, 102365/1977, 9851/1978, 263457/1991, 275364/1992, 275365/1992, 313093/1994, 3135/1995 and 3136/1995 respectively. However, none of these publications disclose that the isocyanate group content in polyurethane is the range of the present invention.

Further, any of these publications are directed to molded articles which are not to be formed into fiber. Although the present inventor attempted to form these particles by spinning into fiber, fiber cutting was significant, thus making winding-up difficult or even if it could be wound, innumerable nodal defects occurred and adequate elongation could not be obtained. Further, mountain-like protrusions were observed on the surface of the wound fiber but the majority of them had a height exceeding 5.0 μm to fail to achieve the effect of preventing luster.

The present invention is to provide polyurethane elastic fiber which is free of the luster phenomenon as well as a process for producing the same.

According to the process of the present invention, high-melting butylene terephthalate-based crystalline polyester (A) is first solidified and then stretched in draft and cooling steps where a melted polymer, discharged from a nozzle in a spinning step, is stretched in high draft and solidified. Hence, a large amount of mountain-like protrusions are generated on the surface of the fiber, and the polyurethane elastic fiber of the present invention can thereby be produced.

DISCLOSURE OF THE INVENTION

The present invention relates to (1) melt-spun polyurethane elastic fiber having a degree of luster of 70 or less, the degree of luster being defined as (I/Io)×100 where the amount of light reflecting off the surface of the fiber is I and the amount of light reflecting off a standard white plate is Io. A preferred embodiment is (2) polyurethane elastic fiber according to item (1) above wherein 10 or more mountain-like protrusions of 0.2 to 5.0 μm in height are present every 10 μm fiber in the axial direction. A further preferred embodiment is (3) polyurethane elastic fiber according to item (2) above wherein 15 to 60 mountain-like protrusions are present.

Also, the present invention relates to: (4) a process for producing polyurethane elastic fiber, comprising melt-spinning butylene terephthalate-based crystalline polyester (A) and thermoplastic polyurethane (B) wherein before spinning, the compound (A) is melt-mixed with thermoplastic polyurethane (B-1) having isocyanate groups in an amount of 150 to 500 μmol/g; (5) a process for producing polyurethane elastic fiber according to item (4) above wherein (A) and (B-1) are mixed at a ratio of 100 parts by weight of (B-1) to 5 to 110 parts by weight of (A); (6) a process for producing polyurethane elastic fiber according to item (4) or (5) wherein another thermoplastic polyurethane (B-2) is added such that the weight ratio of (A), that is, (A)/{(A)+(B-1)+(B-2)} is in the range of 0.05 to 0.2; (7) a process for producing polyurethane elastic fiber according to any one of items (4) to (6) wherein thermoplastic polyurethane (B-1) having isocyanate groups in amount of 150 to 500 μmol/g is produced by compounding the isocyanate compound with polyols in such amounts that the ratio of the number of moles of isocyanate groups to the number of moles of hydroxyl groups is 1.07 to 1.28; (8) covered fiber comprising the polyurethane elastic fiber of item (1), (2) or (3) above as a core; and (9) stockings, tights or sox comprising the covered fiber of item (8) above.

BEST EMBODIMENT FOR CARRYING OUT THE INVENTION

Polyurethane elastic fibers were spun by the above methods or under other conditions than those of the above-described methods and used to produce panty stockings, which were further dyed and finished or not dyed, and the panty stockings thus produced were worn and evaluated visually for the state of luster outdoors i.e. under sunlight. Then, the panty stockings were divided into a permissible group and an impermissible group in terms of the degree of luster. Further, the degree of luster of each polyurethane elastic fiber corresponding to each panty stocking was determined in the method described in the Examples.

The results indicated that the degrees of luster of all polyurethane elastic fibers corresponding to the panty stockings in the permissible group were 70 or less, while the degrees of luster of all polyurethane elastic fibers corresponding to the panty stockings in the impermissible group exceeded 70.

If the degree of luster exceeds 70, the amount of sunlight reflecting off the polyurethane elastic fiber is substantially high, and the resulting panty stockings glisten to cause the luster phenomenon. If the degree of luster is 70 or less, the reflection of light is less, so the visual impression of luster is not bring about. That is, the boundary at which luster is substantially felt or not lies in the degree of luster of 70.

The polyurethane elastic fiber of the present invention is polyurethane elastic fiber with a degree of luster of 70 or less and has preferably fine mountain-like protrusions with a height of 0.2 to 5.0 μm, more preferably 0.2 to 3.0 μm on the surface of the fiber. If the height of the protrusion is less than the above-described lower limit, the effect of lowering fiber luster is inadequate, while the height exceeds the above-described upper limit, the effect of preventing luster cannot be obtained.

In addition, 10 or more, preferably 15 to 60 and more preferably 19 to 50 protrusions are present every 10 μm fiber in the axial direction. Given protrusions less than the above-described lower limit, fiber luster cannot be reduced.

The polyurethane elastic fiber of the present invention is produced by the melt spinning process. Preferably, the polyurethane elastic fiber can be produced by the process for producing polyurethane elastic fiber, comprising melt-spinning butylene terephthalate-based crystalline polyester (A) and thermoplastic polyurethane (B) wherein before spinning, the compound (A) is melt-mixed with thermoplastic polyurethane (B-1) having isocyanate groups in an amount of 150 to 500 μmol/g.

The relative viscosity of butylene terephthalate-based crystalline polyester (A) ranges preferably from 1.7 to 3.0, more preferably from 1.8 to 2.4. When the relative viscosity exceeds the upper limit, the viscosity of the resulting melt is too high, thus causing inadequate mixing with polyurethane, and if the relative viscosity is less than the lower limit, the melt viscosity of the resulting melt is too low, thus making production of pellets (particularly by cutting) difficult after mixed with polyurethane.

Here, the above relative viscosity was measured in the following manner. As the solvent, phenol/1,1,2,2-tetrachloroethane=6/4 (ratio by weight) was used. 0.500±0.0001 g polymer was added to 50 ml of the solvent and dissolved at 120° C. for 50 minutes to prepare a sample solution. Then, the sample solution and the solvent were measured respectively for passage time (sec.) at a temperature of 20° C. with an Ostwald viscometer. The relative viscosity is a value calculated using the following equation:

Relative viscosity=[sample solution passage time (sec.)/solvent passage time (sec.)]

Further, a copolymer of polybutylene terephthalate can also be used as component (A). In this case, the copolymer when melted is preferably incompatible with thermoplastic polyurethane (B). A copolymer with a high content of butylene terephthalate is not preferable because it is compatible with thermoplastic polyurethane (B). Here, incompatibility refers to be judged to be opaque in visual evaluation. If component (A) has a melting point of 210° C. or more as determined by DSC, it is incompatible with (B) though depending on copolymer components to some degrees.

Examples of components copolymerizable with component (A) include diol components e.g. polyalkylene glycols such as dihydroxy polycaprolactam and polytetramethylene diol and acid components e.g. aromatic dicarboxylic acids such as isophthalic acid etc. and aliphatic dicarboxylic acids such as adipic acid etc.

Thermoplastic polyurethane (B-1) has isocyanate groups preferably at the terminal thereof and in an amount of 150 to 500 μmol/g, more preferably 200 to 470 μmol/g. With an amount of less than the above-described lower limit, dispersion between the crystalline polyester component and the thermoplastic polyurethane component (i.e. B-1 and arbitrary B-2) is worse, and at the time of spinning, fiber cutting occurs frequently to make winding-up difficult. Even if the fiber can be wound, innumerable nodal defects occur in the polyurethane elastic fiber and sufficiently stretchable fiber cannot be obtained. Further, fine mountain-like protrusions such as those in the present invention are not generated on the surface of the fiber. In an amount exceeding the above-described upper limit, the phenomenon of gelation of the polymer becomes significant, and fiber cutting occurs frequently to make spinning difficult. By adjusting the isocyanate groups in the above range, micro-dispersion between the crystalline polyester component and the thermoplastic polyurethane component rapidly proceeds to enable significantly superior melt spinning whereby the fiber of the present invention can be obtained.

The thermoplastic polyurethane (B-1) having isocyanate groups in amount of 150 to 500 μmol/g can be produced by compounding and reacting the isocyanate compound with polyols in such amounts that the ratio of the number of moles of isocyanate groups to the number of moles of hydroxyl groups (hereinafter, also called R ratio) is 1.07 to 1.28, more preferably 1.09 to 1.25.

The conventional thermoplastic polyurethane is produced by compounding and reacting the isocyanate compound with polyols at an R ratio in the range of 0.95 to 1.05. Accordingly, the amount of isocyanate groups in the thermoplastic polyurethane thus produced is lower than the lower limit of isocyanate groups possessed by component (B-1) of the present invention, and there are generated the disadvantages of fiber cutting etc. at the time of spinning.

Here, the thermoplastic polyurethane per se is known, and for example, thermoplastic polyurethane described in Japanese Patent Publication No. 46573/1983 can be used. That is, it -includes known segment polyurethane copolymers, for example polymers obtained by reacting polyols with a molecular weight of 500 to 6,000, such as dihydroxy polyether, dihydroxy polyester, dihydroxy polylactone, dihydroxy polyester amide, dihydroxy carbonate and block copolymers thereof, organic diisocyanates with a molecular weight of 500 or less, such as p,p'-diphenylmethane diisocyanate, tolylene diisocyanate, hydrogenated p,p'-diphenylmethane diisocyanate, tetra-methylene diisocyanate, hexamethylene diisocyanate, isophorone diisocyanate, p,5-napthylene diisocyanate etc., and chain-elongating agents with a molecular weight of 500 or less, such as water, hydrazine, diamine, glycol, triol etc. Among these, particularly preferable polymers are those using a polyol such as polytetramethylene ether glycol, or polycaprolactone polyester, or polybutylene adipate, polyhexamethylene adipate, or polycarbonate. The organic diisocyanate is preferably p,p'-diphenylmethane diisocyanate. A particularly preferable chain-elongating agent is glycol, and 1,4-bis(β-hydroxyethoxy)benzene and 1,4-butanediol are preferable.

For polymerization of the thermoplastic polyurethane (B), conventional methods can be used. Such methods include e.g. a melt polymerization method of reacting an isocyanate compound and a polyol in a melted state at a temperature of 190° C. or more and a belt polymerization method of mixing an isocyanate compound with a polyol sufficiently, pouring the mixture onto a heated belt conveyer, and reacting and solidifying it at relatively low temperature of 100 to 150° C. In polymerization of (B-1) in the present invention, the latter belt polymerization method is preferably used whereby abnormal polymerization can be prevented. In the present invention, because (B-1) contains a large number of isocyanate groups after the polymerization is completed, the thermoplastic polyurethane (B-1) is stored preferably in a nitrogen stream or dry air so that the isocyanate groups therein do not react with water.

Butylene terephthalate-based crystalline polyester (A) and thermoplastic polyurethane (B-1) are melt-mixed in such amounts that the upper limit of (A) is preferably 110 parts, more preferably 100 parts by weight and the lower limit of (A) is preferably 5 parts by weight, more preferably 7 parts by weight relative to 100 parts by weight of (B-1). Given an amount exceeding the above-described upper limit, mixing of the two components becomes poor, while given an amount of less than the above-described lower limit, mountain-like protrusions on the surface of the fiber are decreased, so the effect of preventing luster cannot be achieved.

The polyurethane elastic fiber of the present invention can contain the other thermoplastic polyurethane (B-2) such that the ratio of (A)/{(A)+(B-1)+(B-2)} is preferably in the range of 0.05 to 0.2, more preferably 0.075 to 0.2. With a ratio of less than the above-described weight ratio, the number of mountain-like protrusions on the surface of a fiber is less than the range of the present invention, so the effect of preventing luster cannot be achieved. With a ratio exceeding the above-described weight ratio, the physical properties of the resulting fiber after spinning are inadequate. Here, there is no particular limit to the thermoplastic polyurethane (B-2), and the aforementioned (B-1) can also be used.

The method of melt-mixing the butylene terephthalate-based crystalline polyester (A) with the thermoplastic polyurethane (B-1) is not particularly limited, and for example, the respective components are mechanically mixed, then melt-kneaded in a conventional apparatus such as extruder etc. at a temperature of preferably 220 to 250° C., extruded and formed into pellets. A twin-screw extruder in which the two components can be mixed sufficiently at high speed is preferably used.

It is estimated that this mixing involves not only mere mixing of components (A) and (B-1) but also some chemical reaction between the two components. It is considered that by this chemical reaction, micro-dispersion of components (A) and (B-1) is achieved to improve dispersibility.

Further, thepolyisocyanate compound (D) with a molecular weight of 400 or more can be compounded preferably as a cross-linking agent when materials containing a product preparedbymelt-mixing component (A) and (B-1) and arbitrarily containing (B-2) are melt-spun. It is considered that by this, thermostability of the polyurethane elastic fiber can improved, and dispersibility can further be improved by reaction with component (A). Thepolyisocyanate compound may be that described in Japanese Patent Publication No. 46573/1983.

That is, the above-described polyisocyanate compound is a compound having at least 2 isocyanate groups in the molecule and can be synthesized for example by allowing the polyol with a molecular weight of 300 to 2,500 to react with at least 2-fold excess moles of the organic diisocyanate with a molecular weight of 500 or less. Alternatively, a compound having at least 3 hydroxyl groups can also be used as polyol. As the polyisocyanate compound, an organic diisocyanate dimer or carbodiimide-modifiedpolyisocyanate can also be used preferably.

The number of isocyanate groups in one molecule of the polyisocyanate compound ranges preferably from 2 to 4, and particularly the diisocyanate compound is preferable. If there are too many isocyanate groups, thepolyisocyanate compound becomes too viscous and difficult to handle.

The molecular weight of thepolyisocyanate compound is 400 or more, preferably 800 to 3,000. This molecular weight is an apparent molecular weight calculated from the amount of isocyanate groups as determined by an amine titration method. If the molecular weight of the polyisocyanate compound is less than 400, it is denatured due to its high activity during storage, and the lower molecule weight decreases a predetermined amount thereof, thus making its handling difficult. On the other hand, if its molecular weight is too high, the amount of polyisocyanate to be added is increased, so spinning after mixing is often unstable.

Suitable polyisocyanate compounds includes polyols with amolecular weight of 300 to 2,500, e.g. isocyanate-terminated compounds having organic diisocyanate with a molecular weight of 500 or less added to at least one polyol selected from the group consisting of polyether, polyester, polyester amide and polycarbonate. A particularly preferably polyol is polytetramethylene ether glycol, polycaprolactone polyester or polybutylene adipate. The organic diisocyanate is preferably p,p'-diphenylmethane diisocyanate.

The amount of thepolyisocyanate compound added is preferably 3 to 30% by weight, more preferably 5 to 20% by weight relative to the total amount of the above-described polyisocyanate and materials containing a product prepared by melt-mixing component (A) and (B-1) and arbitrarily containing (B-2).

The melt-spinning in the present invention can be practiced using a spinning apparatus including a part where materials containing a product prepared by melt-mixing component (A) and (B-1) and arbitrarily containing (B-2) is melt-extruded, a part where the polyisocyanate compound is added and mixed, and a spinning head.

The part where the polyisocyanate compound is added to and mixed with polyurethane in a melted state may be a kneading apparatus having a rotating part, but a mixing unit with a stationary kneading element is more preferable.

The mixing unit having the stationary kneading element may be conventional one. The shape of the stationary mixing element and the number of elements vary depending on the conditions used, but it is essential that these are selected such that adequate mixing of the polyurethane elastic body with the polyisocyanate compound has been completed before the mixture is discharged from the spinning nozzle.

One embodiment of spinning is described. The product prepared by melt-mixing component (A) with component (B-1), and arbitrarily (B-2), are chip-blended, fed through a hopper, heated and melted in an extruder. The melting temperature is preferably in the range of 190 to 230° C. Separately, the polyisocyanate compound is melted at a temperature of 100° C. or less in a feeding tank and previously defoamed. The polyisocyanate compound is easily denatured at too high melting temperature, so it is preferable to use a lower temperature within the range where the compound can be melted, and a temperature between room temperature and 100° C. can be used as necessary.

The melted polyisocyanate compound is metered in a metering pump, filtered if necessary, and added to the above-described material which is melted at an association part provided at the top of the extruder. The polyisocyanate compound and the material are kneaded in a kneading unit having a stationary kneading element. This mixture is metered by a metering pump and introduced into a spinning head.

The spinning head may be a usual synthetic fiber spinning device, but it is preferably designed to have a shape with less retention of the mixture. After foreign matter is removed if necessary by a filter material such as a wire gauze or glass beads in a filter layer provided in the spinning head, the mixture is discharged from the spinning nozzle, air-cooled, given a lubricant, and wound up. The take-up speed is usually 300 to 1,500 m/min.

The strength of the urethane fiber wound around a spinning bobbin may be inferior just after spinning, but as it is left at room temperature, its strength is increased and its recovery characteristics from elongation at high temperature are also improved. After spinning, thermal treatment is conducted in a suitable manner to promote improvements in fiber properties and thermal performance.

The polyurethane elastic fiber of the present invention produced in this manner can be used as such or preferably covered with polyamide fiber etc. to be used as thin knitted goods etc. such as stockings, panty stockings, tights, sox etc.

The covering fiber for use in stockings, panty stockings etc. includes nylon multi-filament fiber of 5 to 30 deniers with which the polyurethane elastic fiber is covered at a twisting number of 500 to 4,000 T/m. A preferable example of covering fiber is nylon multi-filament fiber of 8 to 20 deniers with which the polyurethane elastic fiber is covered at a twisting number of 1,000 to 2,500 T/m.

The covering fiber for use in tights includes nylon-processed fiber of 30 to 150 deniers with which the polyurethane elastic fiber is covered at a twisting number of 200 to 2,000 T/m. A preferable example of covering fiber include nylon-processed fiber of 40 to 110 deniers with which the polyurethane elastic fiber is covered at a twisting number of 400 to 800 T/m.

The covering method can be either single-covering or double-covering by a generally known covering machine, or a covering method using air can also be adopted.

Hereinafter, the present invention is described in more detail with reference to the Examples, which however are not intended to limit the present invention.

EXAMPLES

Examples 1 to 6 and Comparative Examples 1 to 4

The following materials were used as components (A), (B-1) and (B-2).

<Component (A)>

After adequately drying at 110° C. for about 24 hours, polybutylene terephthalate was used. The relative viscosity was 1.85, and the melting point as determined by DSC (DSC-7 type, made by Perkin-Elmer) was 224° C.

<Component (B-1)>

Thermoplastic polyurethane produced in the following manner was used.

Materials used in preparation thereof and their compounding amounts are as follows:

Polybutylene adipate diol with a molecular weight of 2,000 having hydroxyl groups at both ends: 67 parts by weight (0.035 mol)

1,4-Butanediol: 5.3 parts by weight (0.0589 mol)

p,p'-Diphenylmethane diisocyanate (MDI): 27.7 parts by weight (0.1108 mol)

The ratio (R) of the number of moles of isocyanate groups to the number of moles of hydroxyl groups=1.20

First, after polybutylene adipate diol and 1,4-butanediol were sufficiently mixed at 100° C., MDI heated at 45° C. was added to the mixture and mixed sufficiently at 100° C. for 1 minute. Then, the mixture was continuously poured onto a conveyer heated at 100° C. to conduct polymerization reaction. After the reaction product was cooled until it could be easily removed from the conveyer, the reaction product was removed from the conveyer, then cooled to room temperature and cut into small pieces. The small pieces as component (B-1) were stored in a nitrogen stream.

The isocyanate groups in component (B-1) were determined in the following method. The result indicated the amount of the isocyanate groups was 360 μmol/g.

Method of measuring the amount of isocyanate groups:

(1) 20 ml solution containing 3.25 g dibutylamine/1-liter toluene is mixed with 15 ml dimethylacetamide, and 1 g of the polymer is dissolved in the mixture to give a sample.

(2) 0.04 weight-% bromophenol blue reagent in isopropyl alcohol is prepared as an indicator.

(3) 0.4 ml of the indicator is added to the sample, and the mixture is titrated with 0.05 N hydrochloric acid. The point at which the color of the solution turned from blue to green is regarded as the end point. Here, X ml is assigned to the amount of hydrochloric acid used in titration.

(4) As a blank, the mixture in item (1) above is prepared, and 0.4 ml of the indicator is added thereto, and the mixture is titrated with 0. 05 N hydrochloric acid. Here, Y ml is assigned to the amount of hydrochloric acid used in titration.

(5) The amount of isocyanate (NCO) groups is calculated using the following equation:

$$\text{Amount of NCO groups } (\mu\text{mol/g}) = [(Y-X) \text{ xhydrochloric acid normality } (N) \times 1000]/[\text{polymer weight } (g)]$$

In the measurement method described above, the concentration of the dibutylamine solution and the concentration of hydrochloric acid for titration are suitably varied depending on the amount of the isocyanate groups in the polymer.

<Component (B-2)>

Thermoplastic polyurethane prepared in the following manner was used.

Materials used in preparation thereof and their compounding amounts are as follows:

Polytetramethylene diol with a molecular weight of 1,000: 210 parts by weight (0.420 mol)

1,4-Butanediol: 18.1 parts by weight (0.402 mol)

p,p'-Diphenylmethane diisocyanate (MDI): 105parts byweight (0.840 mol)

The ratio (R) of the number of moles of isocyanate groups to the number of moles of hydroxyl groups=1.02

Polytetramethylene diol heated at 50° C. and MDI heated at 45° C. were sufficiently mixed and passed through a reaction cylinder having a stationary mixing element heated at 55° C. to give a prepolymer. Then, 1,4-butanediol was sufficiently mixed with the above-described prepolymer and then melt-polymerized at a polymerization temperature of 240° C. at a screw revolution of 150 rpm in a 45 mmϕ twin-screw mixing machine to produce polyurethane pellets of 1.5 mmϕ in diameter.

The isocyanate groups, as determined in the same manner as above, were 40 μmol/g.

First, 50 parts by weight of component (A) and 50 parts by weight of component (B-1) were chip-blended uniformly in a conventional tumbler, and then melt-kneaded in a 45 mmϕ twin-screw kneader at a cylinder temperature of 240° C. at a screw revolution of 150 rpm and extruded through a dice whereby pellets of about 1.5 mm in diameter were prepared.

Then, components (A) and (B-1) produced in the above-described manner using the amounts (parts by weight) shown in Tables 1 and 2 and component (B-2) were chip-blended uniformly in a conventional tumbler and then melt-spun to produce polyurethane elastic fiber.

The melt-spinning was practiced in the following manner. A mixture obtained by chip-blending in the manner described above was melted at 220° C. Separately, the cross-linking agent (D) melted at 70° C. with a molecular weight of 1,250 having isocyanate groups at both ends having polycaprolactone diol being reacted at both ends with MDI was mixed in an amount of 15% by weight relative to the total amount of the mixture and the cross-linking agent. Then, the resulting mixture was introduced into a spinning nozzle of 1.0 mm in diameter, extruded into air, wound up at a rate of 600 m/min. and spun into a mono-filament of 20 deniers. The degree of luster of each spun polyurethane elastic fiber was measured, and the heights and the number of mountain-like protrusions thereon were determined. The results are shown in Tables 1 and 2.

Each polyurethane elastic fiber thus obtained was covered with covering nylon fiber 10 deniers/5 filaments under the conditions of 2.6-fold covering draft and the twisting number of 1,500 T/m to produce covered fiber. Then, merely knitted panty stockings consisting of 100% covered fiber at the hosiery portion, and further black-dyed and finished panty stockings, were respectively produced and worn under sunlight, and the state of luster was evaluated. The results are shown in Tables 1 and 2.

The meanings of the symbols and terms in Tables 1 and 2 are shown below.

<Degree of luster>

A 3-dimensional varied-angle photometer MODEL JSG-22 (made by Jonan Seisakusho K. K.) was used to measure a light reflecting off a sample after a projector and a receptor were positioned at an angle of incidence of 30° and an angle of reflection of 30° relative to a normal line on a sample stand. In this measurement, a standard white plate as an accessory of the photometer was placed on the sample stand, and light from the light injector was exposed to the standard white plate. Io was assigned to the amount of light which the standard white plate received from the projector. Polyurethane elastic fiber of 720 m in total wound around a paper tube was re-wound on a square metal plate with a size of 60 mm in one side and a thickness of 0.4 to 1.0 mm at a take-up speed of 12 m/min., at a take-up angle of 0.09° with a roll width of 42 mm and a rolling tensile strength of 0.01 g at which the polyurethane elastic fiber was not elongated (the resulting roll is referred to hereinafter as nuance roll). The nuance roll was placed in the sample stand such that an angle between lines formed by projecting the optical axis of light from the projector and the take-up direction of the nuance-roll polyurethane elastic fiber respectively to a plane perpendicular to a normal line of the sample stand was 0.09°. Then, the nuance-roll fiber was exposed to the same light as light which the standard white plate received from the projector. I was assigned to the amount of light which the receptor received from the nuisance-wound fiber. (I/Io)×100, that is, the degree of luster was thus determined. Given the above fiber length of 720 m in total, the fiber is not affected by the conditions of the surface or color of the metal plate itself, so a material other than the metal plate can be used for preparing the sample.

<State of Luster>

The state of luster was evaluated visually at the time of wearing panty stockings. ⊙: No luster. ○: Slight luster. Δ: Luster. X: Significant luster.

<Measurement of mountain-like protrusions>

An electron microscope (JSM5300, made by JEOL Ltd.) was used and a photograph of the surface of the fiber (magnification: 1,000) was taken. Then, the side of the fiber in the photograph was magnified two thousand times by a photocopier (U-Bix-4060AF, made by Konica Corporation) and examined.

The polyurethane elastic fibers in Tables 1 and 2 were determined in the following manner.

<Denier>

The weight of the fiber cut into 9 cm was determined by a torsion balance so that its denier was calculated.

<Strength, Elongation>

Strength and elongation were calculated from an S—S curve measured with a tensile tester (made by Orientec K. K.) under the following conditions.

Sample length, 10 cm; tensile rate, 50 cm/min.; room temperature, 21±2° C.; and room humidity, 65±5% RH.

<Elongation Restoration>

Two reciprocating continuous measurements were conducted under the conditions of a sample length of 10 cm and a tensile restoration rate of 50 cm/min. As the elongation restoration, (restoration stress/tensile stress)×100 (%) at the time of 80% elongation in the second tensile restoration curve was determined.

TABLE 2

| Comparative Example | 1 | 2 | 3 | 4 |
|---|---|---|---|---|
| Compounding amount of each component | | | | |
| (A) (parts by weight) | — | 50 | 50 | 50 |
| (B-1) (parts by weight) | — | 50 | 50 | 50 |
| (B-2) (parts by weight) | 100 | 3230 | 1010 | 1010 |
| (A) (% by weight) | 0 | 1.5 | 4.5 | 4.5 |
| Degree of luster | 98 | 93 | 75 | 80 |
| Protrusions on fiber surface | | | | |
| Number of protrusions/10 μm | 0 | trace | 7 | 11 |
| Height (μm) | — | — | 0.2–5.0 | 6.0–10.0 |
| State of luster before dyeing | X | X | Δ | X |
| after dyeing | X | X | Δ | X |
| Properties of polyurethane elastic fiber | | | | |
| Denier (denier) | 20 | 20 | 20 | 20 |
| Strength (g/denier) | 2.00 | 1.98 | 1.95 | 1.94 |
| Elongation (%) | 460 | 460 | 460 | 460 |
| Elongation restoration (%) | 93 | 93 | 93 | 93 |

In Examples 1 to 6, the luster was hardly observed in the panty stockings before dyeing or in the panty stockings after dyeing and finishing. The degree of luster of the polyurethane elastic fiber in Example 1 was 47, and the degree of luster of the polyurethane elastic fiber in Example 5 was 9. In Example 1, 18 fine mountain-like protrusions were observed on the surface of the polyurethane elastic fiber every 10 μm fiber in the axial direction.

In Example 5, 58 fine mountain-like protrusions were observed. The heights of all the polyurethane elastic fibers in Examples 1 to 6 were uniform in the range of 0.2 to 5.0 μm. As the number of fine protrusions was increased, the degree of luster was decreased.

On the other hand, in Comparative Example 1 where the product prepared by melt-mixing components (A) and (B-1) was not contained, the luster was significantly observed in the evaluation of wearing the panty stockings. The degree of luster of the polyurethane elastic fiber was 98, and mountain-like protrusions were not observed on the surface of the fiber. Even in Comparative Example 2 where the amount of component (A) was less than the range of the present invention, the luster was significantly observed in

TABLE 1

| Example | 1 | 2 | 3 | 4 | 5 | 6 |
|---|---|---|---|---|---|---|
| Compounding amount of each component | | | | | | |
| (A) (parts by weight) | 50 | 50 | 50 | 50 | 50 | 50 |
| (B-1) (parts by weight) | 50 | 50 | 50 | 50 | 50 | 50 |
| (B-2) (parts by weight) | 900 | 567 | 400 | 233 | 150 | 942 |
| (A) (% by weight) | 5 | 7.5 | 10 | 15 | 20 | 4.8 |
| Degree of luster | 47 | 42 | 32 | 18 | 9 | 70 |
| Protrusions on fiber surface | | | | | | |
| Number of protrusions/10 μm | 18 | 19 | 22 | 47 | 58 | 9 |
| Height (μm) | 0.2–5.0 | 0.2–5.0 | 0.2–0.5 | 0.2–5.0 | 0.2–5.0 | 0.2–5.0 |
| State of luster before dyeing | ○ | ⊙ | ⊙ | ⊙ | ⊙ | ○ |
| after dyeing | ○ | ⊙ | ⊙ | ⊙ | ⊙ | ○ |
| Properties of polyurethane elastic fiber | | | | | | |
| Denier (denier) | 20 | 20 | 20 | 20 | 20 | 20 |
| Strength (g/denier) | 1.95 | 1.90 | 1.80 | 1.40 | 1.00 | 1.95 |
| Elongation (%) | 460 | 450 | 430 | 400 | 370 | 460 |
| Elongation restoration (%) | 93 | 91 | 90 | 88 | 85 | 93 |

the evaluation of wearing the panty stockings, and the degree of luster of the polyurethane elastic fiber was 93, and there was generated only a trace of mountain-like protrusion.

In Comparative Example 3, the luster was observed in the evaluation of wearing the panty stockings. The degree of luster of the polyurethane elastic fiber was 75, and the number of mountain-like protrusions on the surface of the fiber was 7.

In Comparative Example 4, the number of protrusions on the polyurethane elastic fiber was 11, but the heights of the protrusions exceeded 5.0 μm, and the degree of luster was 80, and the luster was significantly observed in the evaluation of wearing the panty stockings.

FIGS. 1 and 2 are electron microphotographs showing the form of the surface of the polyurethane elastic fiber in Example 4. FIGS. 3 and 4 are electron microphotographs showing the form of the surface of the polyurethane elastic fiber in Comparative Example 1. As is evident from each figure, the polyurethane elastic fiber of the present invention possesses a large number of mountain-like protrusions on the surface of the fiber.

Although fiber properties were deteriorated as the content of the product obtained by melt-mixing components (A) and (B-1) was increased, its properties were satisfactory as the elastic fiber.

Examples 7 to 11 and Comparative Examples 5 to 6

The same polybutylene terephthalate as in Example 1 was used as component (A).

Component (B-1) was polymerized and produced in the same manner as in Example 1 except that the following materials were used in the amounts (parts by weight) shown in Tables 3 and 4. The respective ratios (R) of the number of moles of isocyanate groups to the number of moles of hydroxyl groups are as shown in Tables 3 and 4.

The materials used in polymerization are as follows:

Polytetramethylene diol with a molecular weight of 1,000

1,4-Butanediol p,p'-Diphenylmethane diisocyanate (MDI)

The amount of isocyanate groups in the resulting component (B-1), as determined in the same manner as in Example 1, is shown in Tables 3 and 4.

Then, components (A) and (B-1) were melt-kneaded in a twin-screw extruder in the amounts (parts by weight) shown in Tables 3 and 4, and were melted-spun in the same manner as in Example 1 to produce polyurethane elastic fiber.

Then, the properties of the polyurethane elastic fiber were evaluated in the same manner as in Example 1. The results are shown in Tables 3 and 4.

TABLE 3

| Example | 7 | 8 | 9 | 10 | 11 |
|---|---|---|---|---|---|
| Component (B-1) | | | | | |
| Compounding amounts (parts by weight) | | | | | |
| Polytetramethylene diol | 100 | 100 | 100 | 100 | 100 |
| MDI | 50 | 50 | 50 | 50 | 50 |
| 1,4-Butanediol | 7.82 | 7.36 | 6.65 | 6.00 | 5.40 |
| R ratio | 1.07 | 1.10 | 1.15 | 1.20 | 1.25 |
| Isocyanate groups (μmol/g) | 150 | 220 | 310 | 390 | 460 |

TABLE 3-continued

| Example | 7 | 8 | 9 | 10 | 11 |
|---|---|---|---|---|---|
| Compounding amounts (parts by weight) | | | | | |
| (A) | 10 | 10 | 10 | 10 | 10 |
| (B-1) | 90 | 90 | 90 | 90 | 90 |
| Degree of luster | 70 | 30 | 24 | 18 | 23 |
| Protrusions on fiber surface | | | | | |
| Number of protrusions/10 μm | 10 | 28 | 30 | 45 | 42 |
| Height (μm) | 0.2–5.0 | 0.2–5.0 | 0.2–5.0 | 0.2–5.0 | 0.2–5.0 |
| State of luster before dyeing | ○ | ◎ | ◎ | ◎ | ◎ |
| State of luster after dyeing | ○ | ◎ | ◎ | ◎ | ◎ |
| Properties of polyurethane elastic fiber | | | | | |
| Denier (denier) | 20 | 20 | 20 | 20 | 20 |
| Strength (g/denier) | 1.85 | 2.00 | 2.00 | 2.10 | 1.70 |
| Elongation (%) | 460 | 475 | 470 | 410 | 400 |
| Elongation restoration (%) | 93 | 93 | 92 | 92 | 92 |

TABLE 4

| Comparative Example | 5 | 6 |
|---|---|---|
| Component (B-1) | | |
| Compounding amounts (parts by weight) | | |
| Polytetramethylene diol | 100 | 100 |
| MDI | 50 | 50 |
| 1,4-Butanediol | 8.31 | 4.84 |
| R ratio | 1.04 | 1.30 |
| Isocyanate groups (μmol/g) | 85 | 540 |
| Compounding amounts (parts by weight) | | |
| (A) | 10 | 10 |
| (B-1) | 90 | 90 |
| Degree of luster | 86 | — |
| Protrusions on fiber surface | | |
| Number of protrusions/10 μm | 4 | — |
| Height (μm) | 0.2–5.0 | — |
| State of luster before dyeing | X | — |
| State of luster after dyeing | X | — |
| Properties of polyurethane elastic fiber | | |
| Denier (denier) | 20 | — |
| Strength (g/denier) | 1.30 | — |
| Elongation (%) | 350 | — |
| Elongation restoration (%) | 92 | — |

In Examples 7 to 11, the amount of isocyanate groups in component (B-1) was varied within the range of the present invention. On any fiber surface, 10 or more protrusions of 0.2 to 5.0 μm in height were observed every 10 μm fiber in the axial direction, and the degree of luster was 70 or less. It was found that the number of the protrusions was increased as the amount of isocyanate groups in (B-1) was increased. Further, the degree of luster was decreased as the number of the protrusions was increased. In the evaluation of wearing the panty stockings, the luster was hardly observed. Further, the properties of any elastic fibers were good.

On the other hand, thermoplastic polyurethane with isocyanate groups contained in an amount of less than the range of the present invention was used in Comparative Example 5. The melted polymer extruded from the nozzle was found to possess draft irregularity in the thinning step, and fiber cutting frequently occurred. Further, the wound fiber had a large number of nodal defects. The number of fine mountain-like protrusions was significantly low, and the degree of luster was 86. Further, the luster was significantly observed in the evaluation of wearing the panty stockings. The properties (strength and elongation) of the elastic fiber were lower than in the Examples.

In Comparative Example 6, the thermoplastic polyurethane with isocyanate groups exceeding the range of the present invention was used. The phenomenon of gelation of the polymer was significant, and fiber cutting occurred at the nozzle to make spinning infeasible.

Examples 12 to 19 and Comparative Examples 7 to 8

Components (A), (B-1) and (B-2) were the same as in Example 1. Components (A) and (B-1) were melt-kneaded in the amounts (parts by weight) shown in Tables 5 and 6 in the twin-screw extruder in the same manner as in Example 1 to give a product. Then, the product produced by melt-kneading components (A) and (B-1), and component (B-2), were chip-blended in the weight parts shown in Tables 5 and 6 and mixed uniformly in the same manner as in Example 1, and then melt-spun in the same manner as in Example 1 to give polyurethane elastic fiber. Then, the polyurethane elastic fiber was evaluated in the same manner as in Example 1 for the state of luster by wearing the panty stockings. The results are shown in Tables 5 and 6. In the tables, the item "spinnability" shows fiber cutting at the time of spinning, "◎" means that fiber cutting hardly occurs, "○" means that slight fiber cutting occurs, and "x" means that spinning is not feasible due to fiber cutting.

TABLE 5

| Example | 12 | 13 | 14 | 15 | 16 | 17 | 18 | 19 |
|---|---|---|---|---|---|---|---|---|
| Compounding amount of each component | | | | | | | | |
| (A) (parts by weight) | 5 | 7 | 15 | 30 | 50 | 70 | 100 | 110 |
| (B-1) (parts by weight) | 100 | 100 | 100 | 100 | 100 | 100 | 100 | 100 |
| (B-2) (parts by weight) | 0 | 0 | 75 | 170 | 350 | 290 | 330 | 370 |
| (A) (% by weight) | 4.8 | 6.5 | 7.9 | 10.0 | 10.0 | 15.2 | 18.9 | 19.0 |
| Spinnability | ◎ | ◎ | ◎ | ◎ | ◎ | ◎ | ◎ | ○ |
| State of luster | | | | | | | | |
| before dyeing | ○ | ◎ | ◎ | ◎ | ◎ | ◎ | ◎ | ◎ |
| after dyeing | ○ | ◎ | ◎ | ◎ | ◎ | ◎ | ◎ | ◎ |

TABLE 6

| Comparative Example | | 7 | 8 |
|---|---|---|---|
| Compounding amount of each component | | | |
| (A) (parts by weight) | | 3 | 120 |
| (B-1) (parts by weight) | | 100 | 100 |
| (B-2) (parts by weight) | | 0 | 410 |
| (A) (% by weight) | | 2.9 | 19.0 |
| Spinnability | | ◎ | X |
| State of luster | before dyeing | X | — |
| | after dyeing | X | — |

In Examples 12 to 19, the amount (parts by weight) of component (A) relative to component (B-1) was varied within the range of the present invention. The spinnability of any fibers was good. Further, the state of luster in evaluation of wearing the panty stockings (stained and finished panty stockings) made of the polyurethane elastic fibers in Examples 12 to 19 was also permissible.

In Comparative Examples 7 to 8, on the other hand, the amount (parts by weight) of component (A) relative to component (B-1) was not in the range of the present invention. In Comparative Example 7 where the amount (parts by weight) of component (A) relative to component (B-1) was less than the range of the present invention, the spinnability was good, but the luster was significantly observed in evaluation of wearing the panty stockings. Further, in Comparative Example 8 where the amount (parts by weight) of component (A) relative to component (B-1), fiber cutting occurred frequently because of inadequate mixing of component (A) with component (B-1), so the polyurethane elastic fiber cannot be recovered.

INDUSTRIAL APPLICABILITY

The polyurethane elastic fiber possesses excellent stretching characteristics and is thus used widely in the fields of hosiery, underwear, sportswear, corset etc. The urethane elastic fiber of the present invention, while maintaining the characteristics of the elastic fiber, is free of the luster phenomenon occurring in melt-spun urethane fiber, and its product is excellent in appearance. Accordingly, the elastic fiber of the present invention can be used preferably In the above-described fields.

Figure 1:
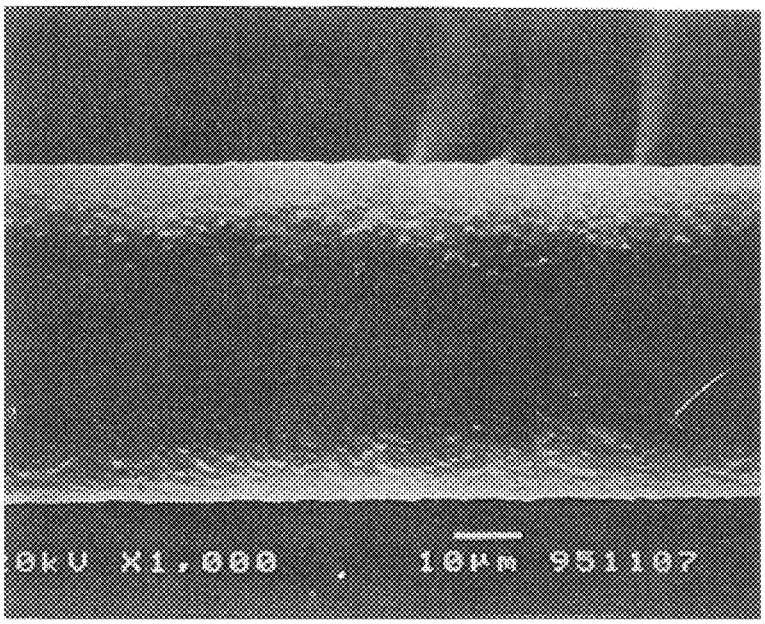
FIG. 1 is an electron microphotograph (magnification: 1,000) showing the form of the polyurethane elastic fiber produced in Example 4.
Figure 2:
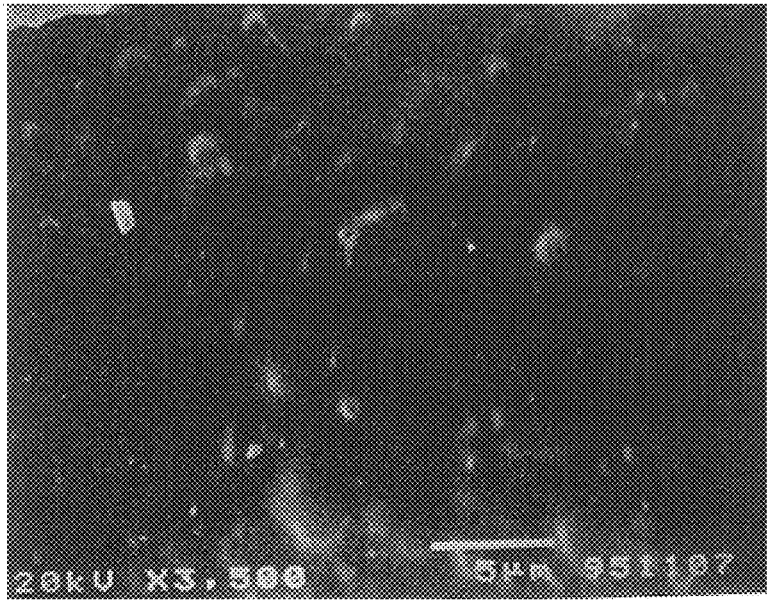
FIG. 2 is an electron microphotograph (magnification: 3,500) showing the form of the polyurethane elastic fiber produced in Example 4.
Figure 3:
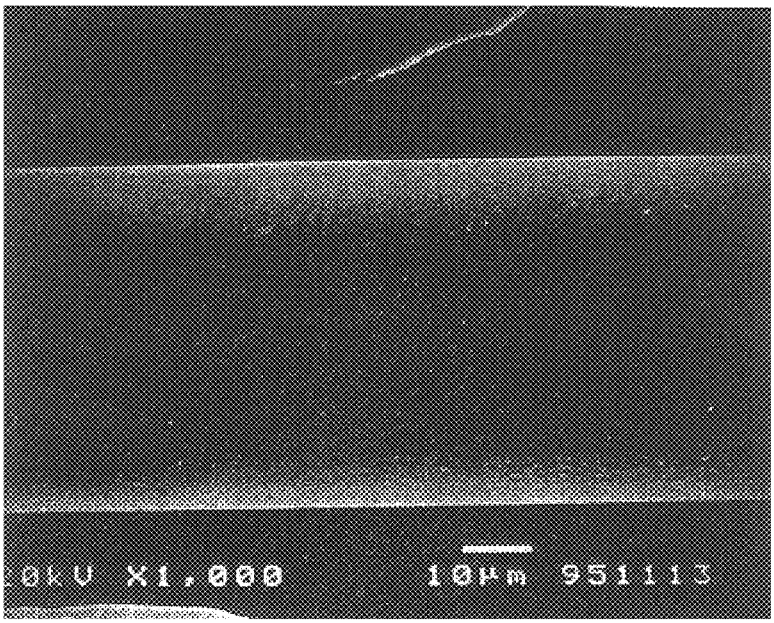
FIG. 3 is an electron microphotograph (magnification: 1,000) showing the form of the polyurethane elastic fiber produced in Comparative Example 1.
Figure 4:
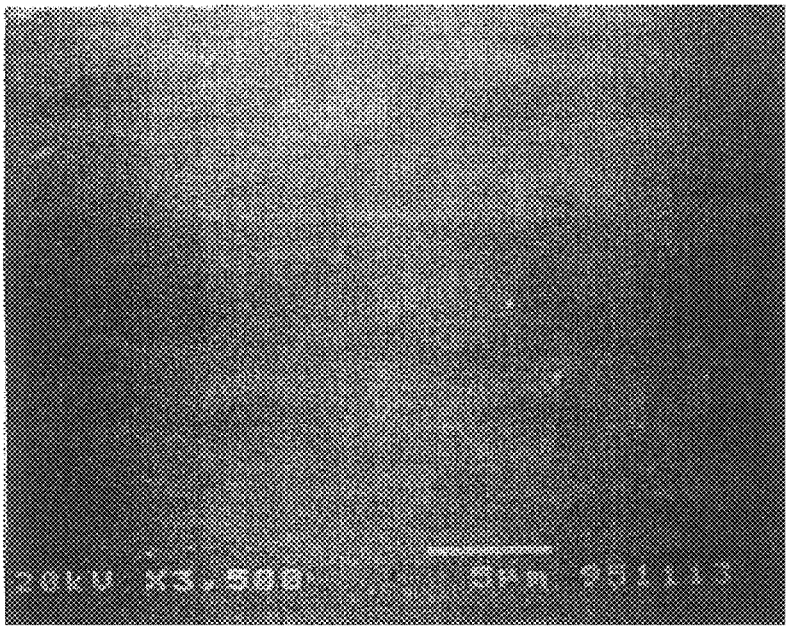
FIG. 4 is an electron microphotograph (magnification: 3,500) showing the form of the polyurethane elastic fiber produced in Comparative Example 1.

We claim:

1. A melt-spun polyurethane elastic fiber having a degree of luster of 70 or less, the degree of luster being defined as $(I/Io)\times100$ where the amount of light reflecting off the surface of the fiber is I and the amount of light reflecting off a standard white plate is Io.

2. The polyurethane elastic fiber according to claim 1, wherein 10 or more mountain-like protrusions of 0.2 to 5.0 $\mu$m in height are present every 10 $\mu$m fiber in the axial direction.

3. The polyurethane elastic fiber according to claim 1 or 2, wherein 15 to 60 mountain-like protrusions are present every 10 $\mu$m fiber in the axial direction.

4. A process for producing a polyurethane elastic fiber, comprising melt-spinning butylene terephthalate-based crystalline polyester (A) and thermoplastic polyurethane (B) wherein before spinning, the compound (A) is melt-mixed with thermoplastic polyurethane (B-1) having isocyanate groups in an amount of 150 to 500 $\mu$mol/g.

5. A process for producing a polyurethane elastic fiber according to claim 4, wherein (A) and (B-1) are mixed at a ratio of 5 to 110 parts by weight of (A) to 100 parts by weight of (B-1).

6. A covered fiber comprising the polyurethane elastic fiber of claim 1, 2 or 3 as a core.

* * * * *

UNITED STATES PATENT AND TRADEMARK OFFICE

CERTIFICATE OF CORRECTION

PATENT NO. : 6,048,613

DATED : April 11, 2000

INVENTOR(S) : Yukio Yamakawa; Yasushi Nakai; Kiyoshi Yoshimoto; Shigeru Tokutomi; Teruyoshi Kawata It is certified that error appears in the above-identified patent and that said Letters Patent is hereby corrected as shown below:

On the cover page, at item [54], please delete "Elastic Polyurethane Yarn and Method Of Manufacturing The Same" and substitute therefor --Polyurethane Elastic Fiber and Process For Producing Same--.

Signed and Sealed this

Twenty-seventh Day of March, 2001

Nicholas P. Godici

*Attest:*

NICHOLAS P. GODICI

*Acting Director of the United States Patent and Trademark Office*

*Attesting Officer*